US005918809A

United States Patent [19]

Simmons

[11] Patent Number: 5,918,809

[45] Date of Patent: Jul. 6, 1999

[54] APPARATUS FOR PRODUCING MOVING VARIABLE-PLAY FOUNTAIN SPRAYS

[76] Inventor: Thomas R. Simmons, 3510 Lobit, Dickinson, Tex. 77539-4310

[21] Appl. No.: 08/957,931

[22] Filed: Oct. 27, 1997

Related U.S. Application Data

[60] Provisional application No. 60/029,287, Oct. 29, 1996, and provisional application No. 60/031,873, Nov. 29, 1996.

[51] Int. Cl.[6] ..... B05B 17/08

[52] U.S. Cl. ..... 239/17; 239/18; 239/211

[58] Field of Search ..... 239/16, 17, 18, 239/22, 23, 211

[56] References Cited

U.S. PATENT DOCUMENTS

| | | | |
|---|---|---|---|
| 1,918,874 | 7/1933 | Shannahan | 239/211 X |
| 2,968,120 | 1/1961 | Reed | 239/17 X |
| 3,088,675 | 5/1963 | Bone | 239/23 X |
| 3,622,074 | 11/1971 | Frohwerk | 239/23 X |
| 4,819,874 | 4/1989 | Geiger | 239/23 |
| 4,974,779 | 12/1990 | Araki et al. | 239/18 |
| 5,165,777 | 11/1992 | Kira | 239/18 X |
| 5,524,822 | 6/1996 | Simmons | 239/17 |

*Primary Examiner*—Andres Kashnikow
*Assistant Examiner*—Steven J. Ganey
*Attorney, Agent, or Firm*—Marvin J. Marnock

[57] ABSTRACT

The invention is an apparatus for producing fountain displays which include moving variable-play fountain sprays and comprises one or more nozzles with dual entry or multi-entry ports which are mounted on one or more moveable floats and are connectable to a source of pressurized liquid through a control apparatus which includes an alternating valve and valve system for producing oscillating, stationary and intermittent nozzle dispersal streams. The moveable floats can be controlled to move by mechanically means or hydraulically by the thrust of one or more nozzle dispersal streams from an underwater nozzle or nozzles mounted below the waterline to thereby provide for complex movements of the various nozzle dispersal streams included in a particular fountain display.

15 Claims, 10 Drawing Sheets

FIG. 8
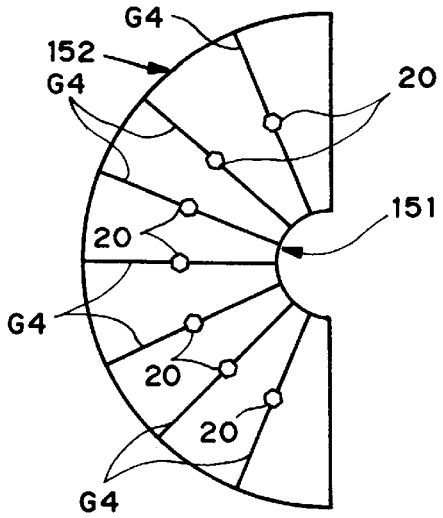
FIG. 9
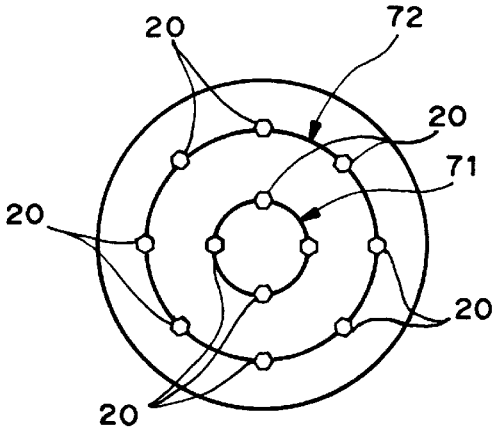
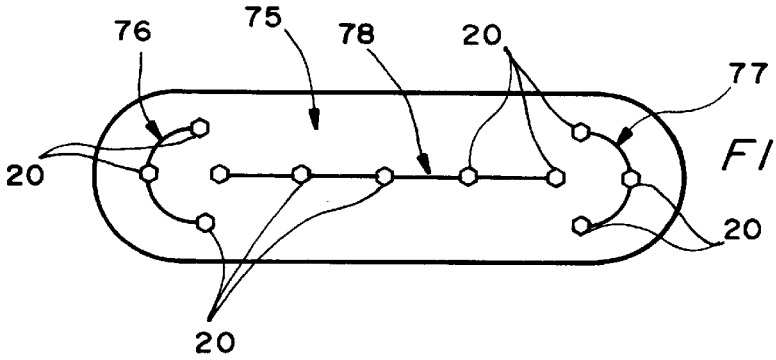
FIG. 10
FIG. 11
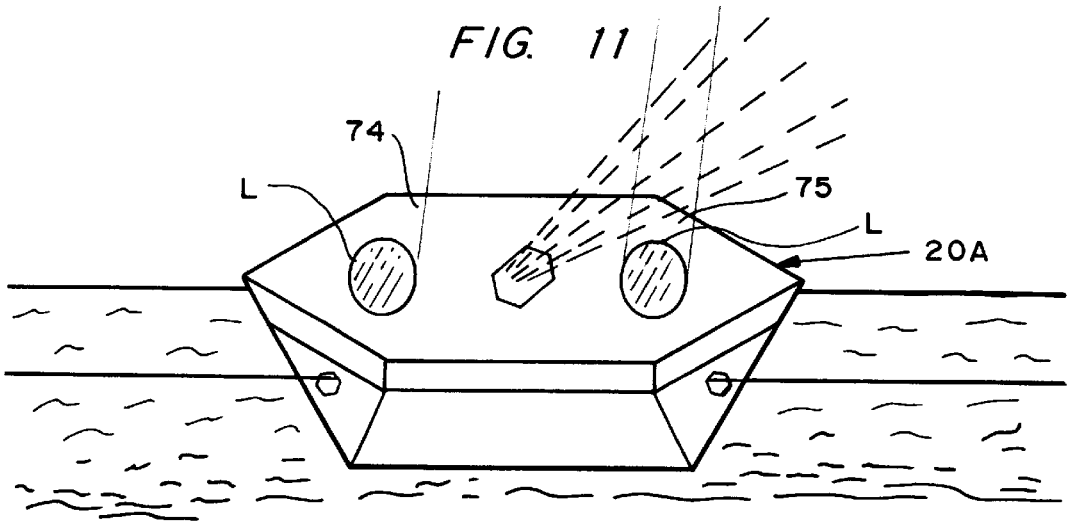

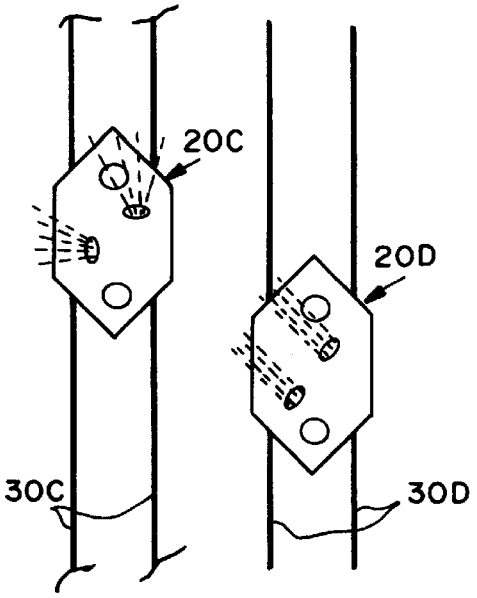
FIG. 12
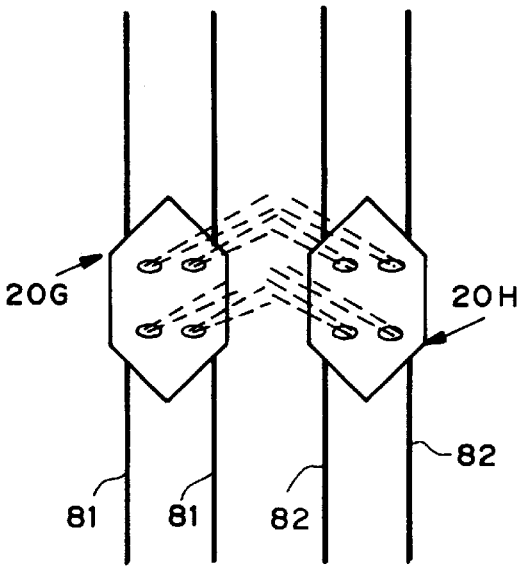
FIG. 14
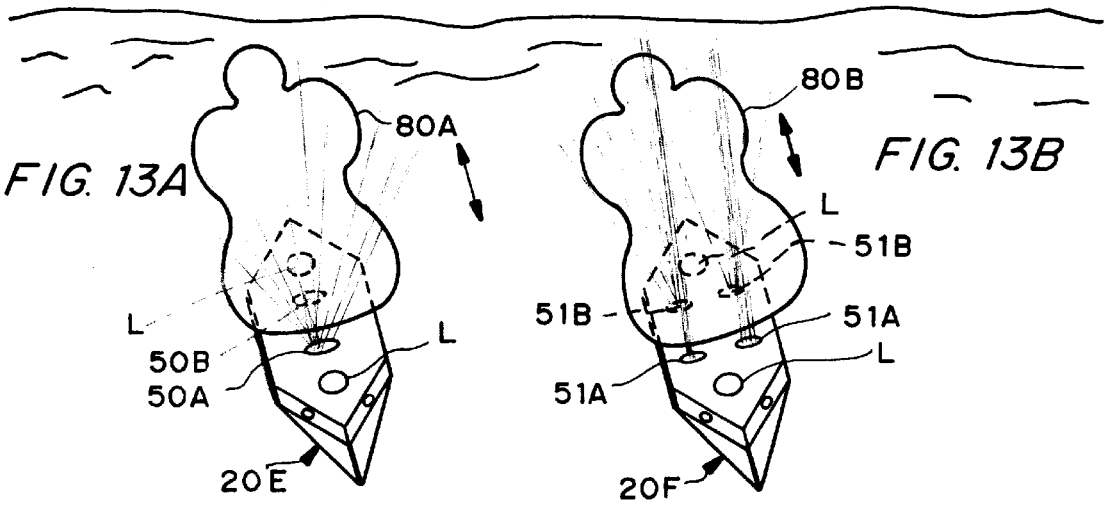
FIG. 13A
FIG. 13B
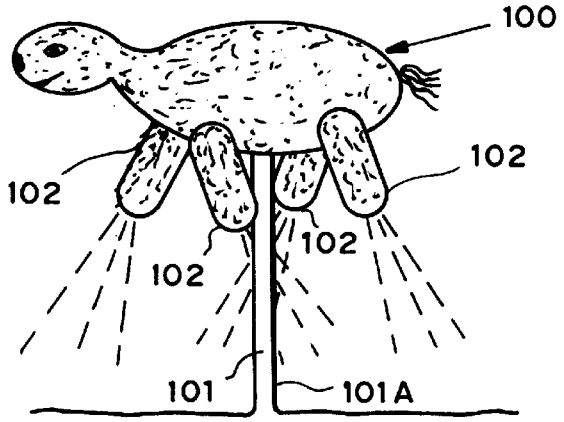
FIG. 15

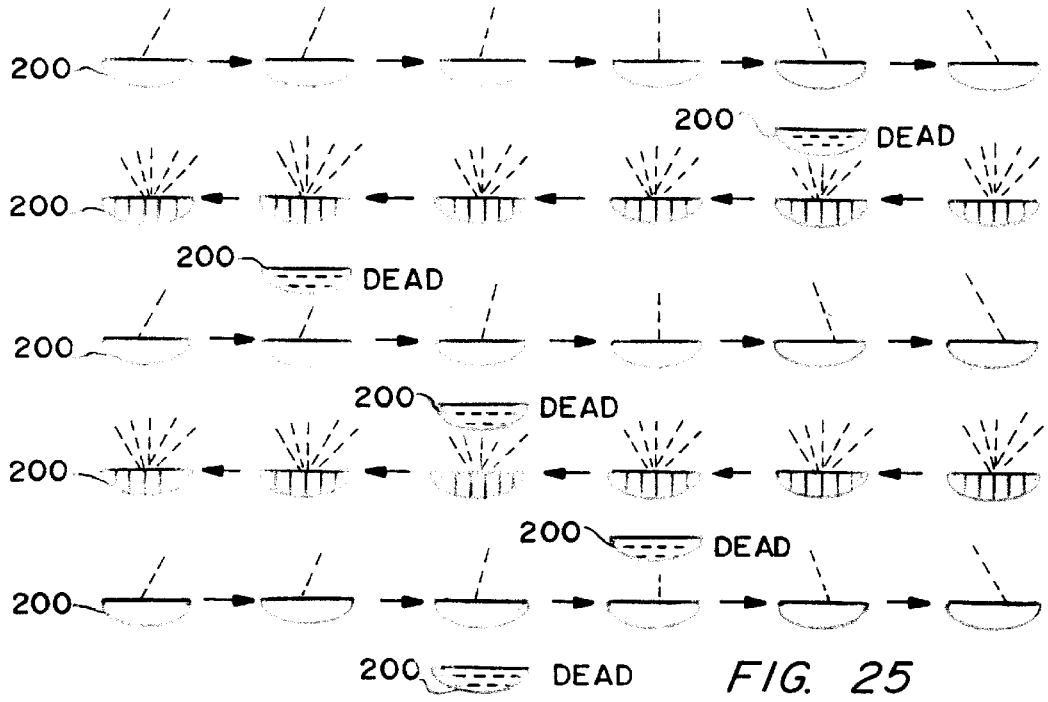
FIG. 25
FIG. 26
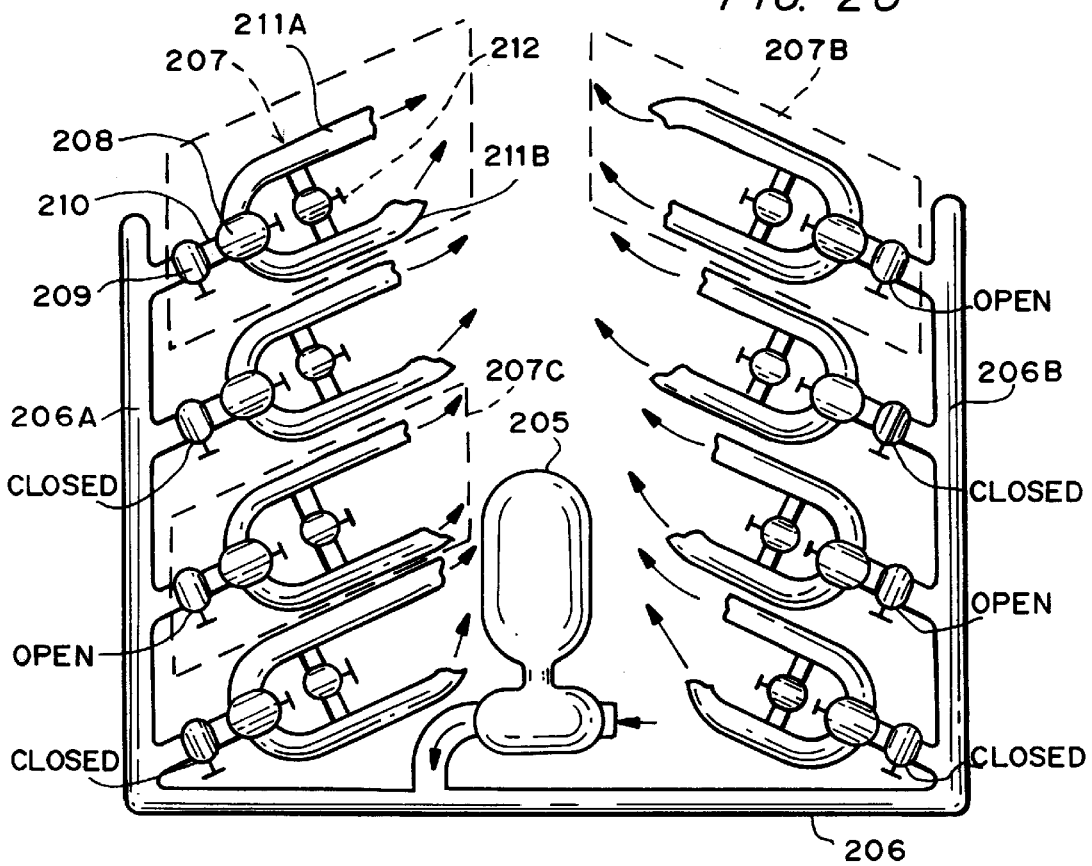

APPARATUS FOR PRODUCING MOVING VARIABLE-PLAY FOUNTAIN SPRAYS

This application is based on Provisional Application, Ser. No. 60/029,287, filed Oct. 29, 1996 and a Provisional Application Ser. No. 60/031,873, filed on Nov. 29, 1996.

FIELD OF THE INVENTION

The invention relates to an apparatus for producing moveable fountain displays and comprises one or more fountain nozzle bases, on each of which is mounted one or more dual-entry, multi-entry or single entry nozzles having means for producing a nozzle dispersal stream adapted for oscillatory movement, linear movement or other complex movement in a controlled or intermittent manner.

BACKGROUND OF THE INVENTION

Apparatus for producing variable-play fountain sprays is disclosed in U.S. Pat. No. 5,524,822 and multi-entry nozzles adapted to produce "fan-like" and "stick-like" dispersal streams in U.S. Pat. Nos. 4,177,927 and 5,524,822, respectively.

SUMMARY OF THE INVENTION

The present invention relates to apparatus for producing moving variable-play fountain sprays wherein multi-entry nozzles are adapted to produce the various dispersal streams, whether oscillating intermittent or stationary, and are mounted on moveable bases or floats which can be controlled to move by mechanical means or hydraulically by thrust produced by the jet stream issuing from a multi-entry nozzle mounted on the float.

BRIEF DESCRIPTION OF THE DRAWINGS

FIG. 8 is a plan view of an array of nozzle equipped moveable floats of the type shown in FIG. 1 and wherein the floats are mounted on guides for reciprocating radial movement with respect to the center of a pair of semi-circular rigid guide support members;

FIG. 9 is a plan view of a plurality of concentric circular arrays of nozzle equipped floats of the type shown in FIG. 1;

FIG. 10 is a plan view of another form of fountain display which comprises three groups of nozzle-equipped floats mounted in an elongate substantially rectangular pool having arcuate ends;

FIG. 11 is a perspective view of a float equipped with nozzles for producing moveable dispersal streams similar to the float of FIG. 1 but further provided with means for producing different colored upwardly directed light beams;

FIG. 12 is a plan view of a pair of nozzle equipped floats of the type shown in FIG. 11, each mounted on guide means in spaced parallel relation and adapted for reciprocating linear movement along their respective guides;

FIGS. 13A and 13B show another type of fountain display wherein a flexible plastic sheet is fastened along one edge to a nozzle equipped float and wherein the nozzles are of a type for producing a fin-like dispersal;

FIG. 14 is a top plan of another fountain display wherein a pair of floats, each equipped with nozzles for producing "stick-like" dispersals, are mounted for moving on adjacent parallel guide means and are controllable to produce a display for simulating children in the act of fighting one another;

FIG. 15 is a display for simulating an animal walking on water and wherein the animal is an inflated balloon provided with nozzles mounted to its interior at the junctions of the animal's legs with its body and each of which is adapted to provide an oscillating dispersal stream for moving the animal's leg in a pivotal motion to simulate walking;

FIG. 25 is a schematic view showing the relative positioning of ten nozzle float boats controlled in movement to produce a plurality of moving nozzle dispersal streams and sprays for producing a fountain display;

FIG. 26 is a fragmentary schematic plan view of the control apparatus and valving system which is used to deliver water to the nozzles mounted on the float boats shown in FIG. 25;

DETAILED DESCRIPTION OF THE INVENTION

Figure 1:
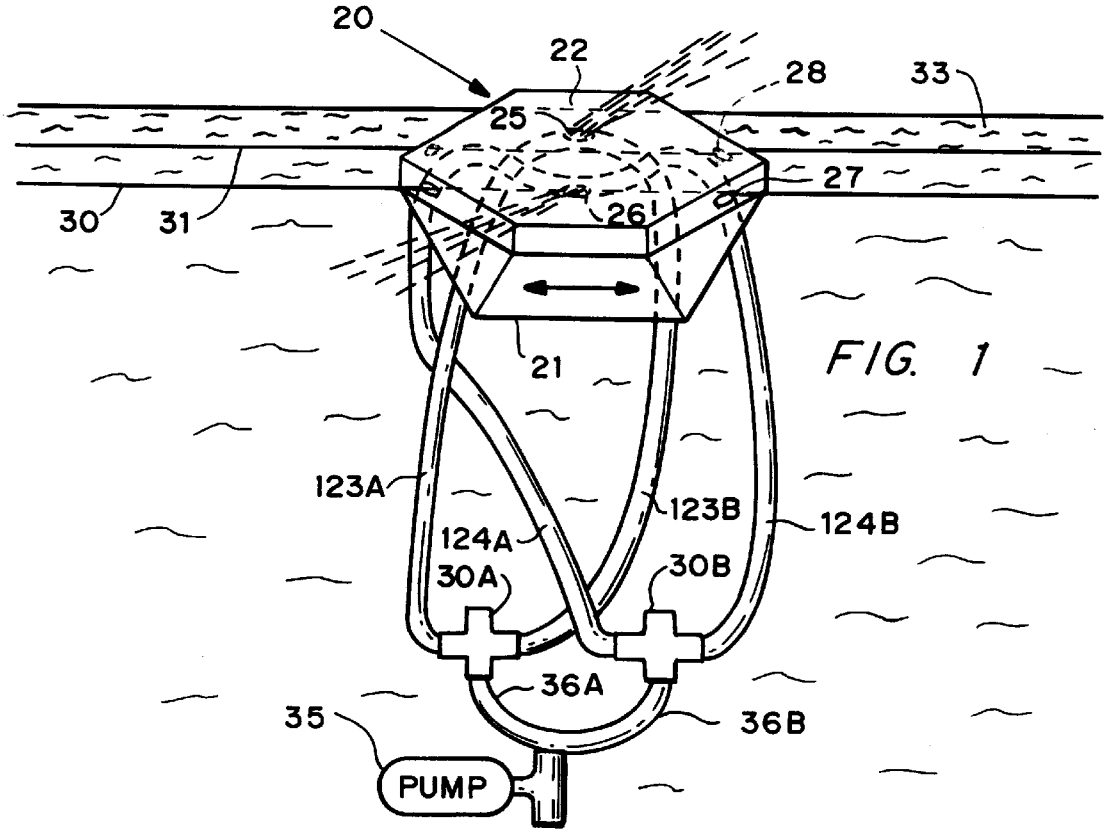
FIG. 1 is a perspective view of a float equipped with nozzles in accordance with the invention and connected by flexible hoses to an underwater pump and valve system.

Referring more particularly to the drawings there is shown in FIG. 1 a nozzle base 20 configured so as to be able to move easily through water, and provided with a boat-like hull 21 and a deck 22 with a deck opening 23 for accommodating the nozzle outlet of a nozzle 25. The fountain bases are adapted to be moved in a controlled manner of movement by mechanical drive and guide means or by solely changing the water pressure or water volume to an underwater nozzle 26 mounted on the base 20 and directed downwardly whereby additional movement characteristics may be provided to the nozzle streams issuing from a fountain base so as to produce various fountain displays. A plurality of such fountain bases 20 may also be arranged in an array as a group in a particular spatial relationship to one another such that their plurality of nozzle dispersal streams are adapted to move in concert or to interact with one another to produce a particular display. The base is adapted to move in a reciprocatory sliding manner along the wire guides by provision of a dual entry nozzle 26 with its exit aperture below the water line whereby oscillatory motion of its dispersal stream drives the base 20 back and forth along the guide wires. The nozzle 26 is arranged and mounted such that its dispersal stream will oscillate and pivot in a fore and aft vertical plane through the keep of the float base 20 and in an arc of movement which is approximately 180 degrees.

It is thus to be appreciated that the group arrangements may be varied as desired to produce different displays. Such displays may include plastic tubes or other flexible tubes, sheets or bodies which might be filled with air, water, foam or the like so as to simulate and imitate people, animals, flowers, trees or buildings. In addition, all the hydraulic driven maneuvers may be assisted by pneumatic or mechanical means.

The nozzle base 20 shown in FIG. 1 may be made of a variety of materials. In one form it may be provided with a pair of longitudinal bores 27, 28 extending parallel therethrough. The base is slidable mounted on a pair of guide wires, 30, 31 which extend through the pair of bores and are fixed at their ends at opposite sides of a water filled pool. The bores and wires located just below the surface 33 of the water so that the top deck 22 of the base (or float) and the deck nozzle opening are just above the surface of the water. However, in lieu of parallel wires, the base might be provided with a longitudinally extending slot of rectangular cross section and mounted on an elongated rod of similar cross section. For either case, the wires or elongated rod serve as guides on which the nozzle base is adapted to move in either direction along the length thereof. The guide wires or guide rod also serve to prevent the nozzle base from rotating.

As will be further seen in FIG. 1, each of the nozzles 25, 26 to be hereafter further described has a pair of entry ports which are connected by flexible conduits or hoses 123A, 123B and 124A, 124B, respectively, to the dual outlets of an alternating valve. The nozzle 25 is shown connected to valve 30A by conduits 123A, B and nozzle 26 is shown connected to the valve 30B by conduits 124A, B. Both of the valves 30A, 30B are connected to receive pressurized water from a pump 35 which is connected at its outlet to the inlets of the valves 30A and 30B by branched outlet conduits 36A, 36B. The pump can be a submersible pump or it could be located poolside.

The nozzles shown on the nozzle base or float 20 are shown as dual entry nozzles of the type which provides an oscillating flip-flop "fan-like" dispersal stream as described in U.S. Pat. No. 4,177,927 and shown in FIGS. 2 and 4 or a type of nozzle which provides a "stick-like" dispersal stream as described in U.S. Pat. No. 5,524,822 and shown in FIG. 2. The dual-entry nozzle is particularly suited for use where a back-and-forth motion of the dispersal stream is desired, which can be accomplished by selectively increasing the flow to one inlet conduit as compared with the flow in the other, or to re-position the nozzle dispersal stream in an instantaneous manner by abruptly transferring a full pressure flow from one input port to the other.

Figure 2:
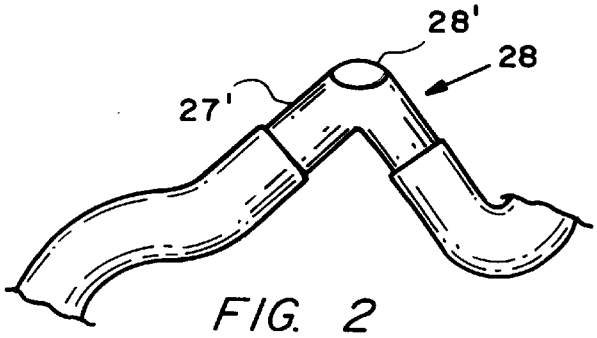
FIG. 2 is a perspective view of a dual-entry nozzle as is mounted on the float in FIG. 1 and which is suitable for producing a "stick-like" dispersal stream.

A dual entry nozzle as shown in FIG. 2, which can be used in the apparatus of the invention for producing a "stick-like" dispersal stream, comprises an inverted V-shaped tube 27' with an exit aperture 28' provided at the apex of the tube. When two pressured flows are delivered from opposite ends of the tube 27' as from a valve 30A or 30B, they are merged just outside the exit aperture 28' at a location which can be adjusted by changing the angle of juncture of the legs of the V-shaped tube.

Figure 4:
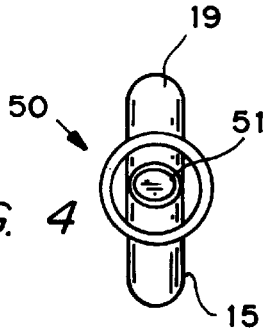
FIG. 4 is a front view of the nozzle of FIG. 3, the view being taken along the line 4—4 in FIG. 3.
Figure 3:
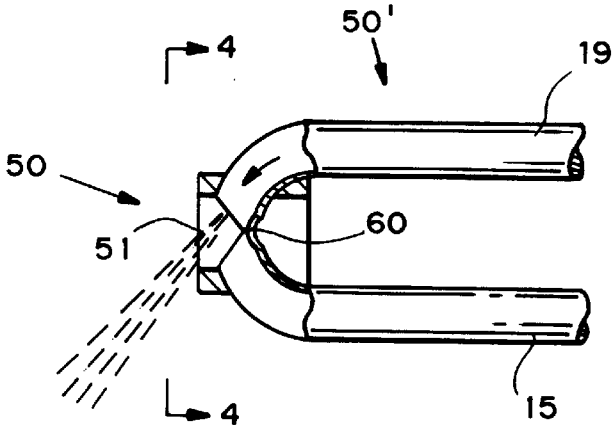
FIG. 3 is a side view, partly in cross section, of a dual entry nozzle as is mounted on the float in FIG. 1 and which is suitable for producing a "fan-like" dispersal stream.

A nozzle 50 which is adapted to produce a "fan-like" dispersal stream is shown in FIGS. 3 and 4. The nozzle is constructed of a V-shaped tube 50' having a wedge shaped aperture 51', which appears as a sector of a circle as seen in the end view FIG. 4, and provides the spray exit. The nozzle includes first and second feed lines 15 and 19 for delivering water to the nozzle aperture 51 for dispersal. A flow deflector means 60 formed as a crimp in the tube 5', as shown in FIG. 4, shapes the dispersal stream in substantially planar form. By alternation of the flows to the two end ports of the tube 50', as from a valve 30A, the fan-like planar dispersal 52 from the nozzle will flip-flop in an oscillating fanning action.

Figure 5:
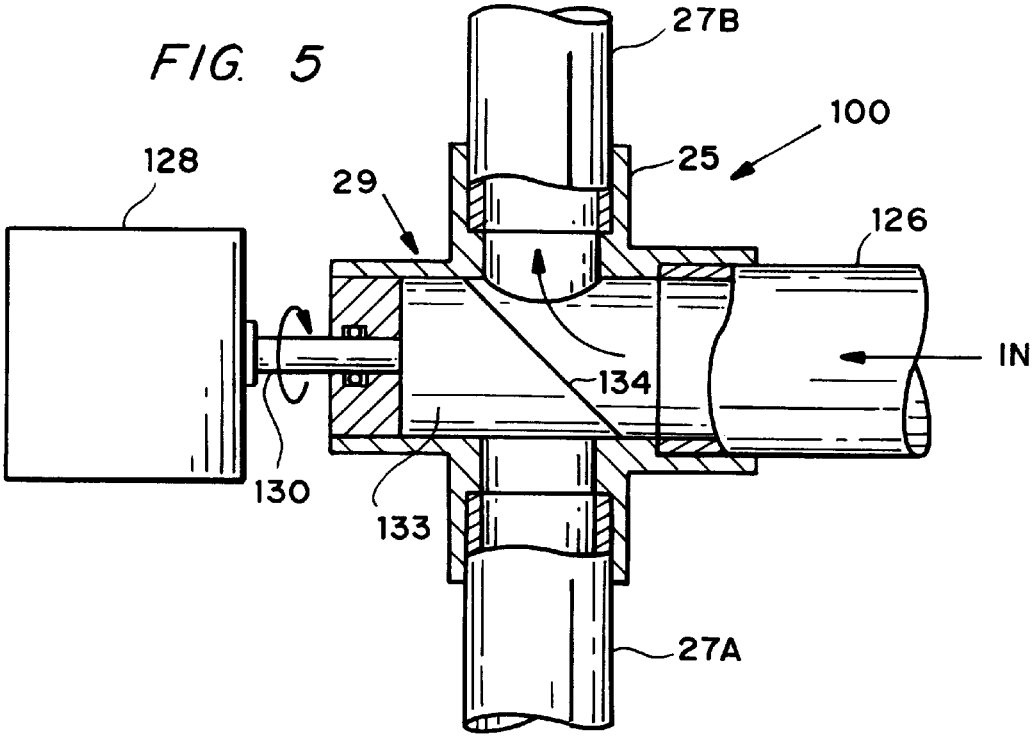
FIG. 5 is a view in cross section of a diverter valve which is operable for delivering water alternatively and intermittently to the pair of entry ports of a dual entry nozzle as is mounted on the float in FIG. 1.

Referring now to FIG. 5, there may be seen a more detailed pictorial representation, partly in cross section, of the alternating valve 100 depicted more generally in FIG. 1 as valve 30A or 30B. More particularly, the alternating valve may be seen to comprise a four-way tubular body member 29 having a port for receiving water through the conduit 126, a port interconnected with conduit 27A and a third port interconnected with conduit 27B. As hereinbefore stated, the alternating valve performs its function in response to rotation of the shaft 130 by the motor 128. Accordingly, the four-way tubular housing of the alternating valve is further provided with a fourth outlet for sealingly accepting the free-traveling of the shaft 130 which, in turn, is fixedly connected to the opposite end of a frustro-conical member hereinafter referred to as valve element 133 which is a cylindrical member having a canted surface 134 confronting the stream of water issuing from the pump 35 and delivered through the conduit 126. When valve element 133 is revolved so that its canted surface 134 faces conduit 126 and also the conduit 27B (as illustrated in FIG. 5) the input to conduit 27A will be blocked and all flow through conduit 126 will be diverted into conduit 27B. Alternatively, when the shaft 130 rotates 180 degrees to revolve the valve element 133 within the four-way tubular housing 29, the canted surface 134 of the element 133 will be positioned to divert water from the conduit 126 into the conduit 27A, and all flow from conduit 126 will be blocked from the conduit 27B.

The effect of revolving the valve element 133 is to cause pressured water to be alternatively and intermittently shifted between the noses 123A and 123B of nozzle 25 and hoses 124B, and to thereby cause the output streams from the nozzles to oscillate.

It is also to be appreciated that the nozzle bases or floats 20 shown in any of the foregoing displays might also be provided with lights L such as shown in the base 20A in FIG. 11 where a pair of different colored light beams 74, 75 are radiated from lights L mounted on the base. The lights mounted on the base 20A may be battery-powered or connected by wires to an appropriate electrical power source.

Figure 6:
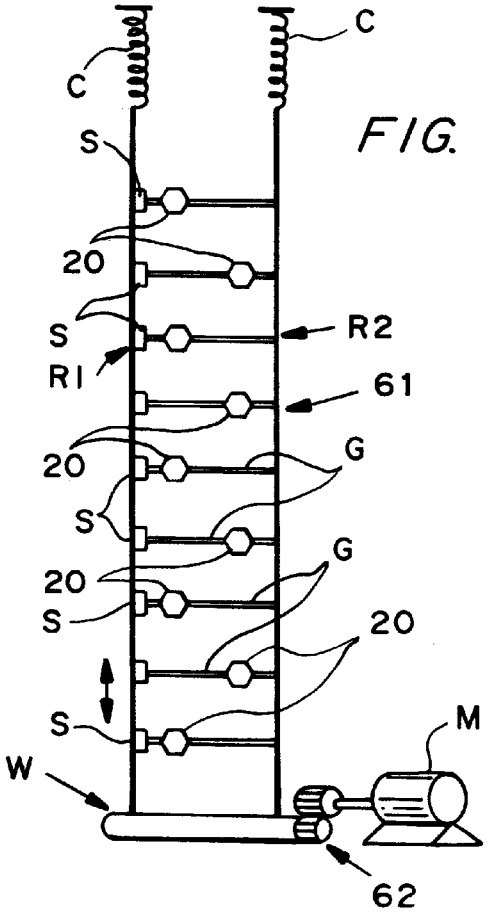
FIG. 6 is a plan view of an array of nozzle-equipped noveable floats, each mounted on guide means connected in parallel between a pair of axially moveable elongate mounting rods.

In FIG. 6, there is shown a plurality of nozzle bases or floats 20 arrayed in a rectangular pool of water 61 for providing an attractive fountain display. Each of the nozzle bases 20, which is substantially identical to the nozzle base shown in FIG. 1, is mounted on its own guide means G, a pair of parallel guide wires such as guide wires 30, 31, one end of each of which is fixed to a long rod R1 at one side of the pool. The other ends of each pair of the wires at the other side of the pool are each fixed to the movable core of a solenoid, one solenoid being provided for each pair of guide wires and each solenoid being mounted on an elongated rod R2 parallel to the rod R1. The respective guide means G are in parallel relation to each other and the nozzles on the several floats 20 are each connected by flexible hoses to the outlet of a pump through an alternating valve such as a valve 30A and connecting hoses such as the hoses 123A, 123B as shown in FIG. 1.

Since the array of nozzle bases 20 shown in FIG. 6 are equipped with dual entry nozzles, each base is adapted to move in reciprocating fashion along its guide means G when the pump is energized and the alternating valve is in operation. The bases or floats 20 may be controlled to move in concert, in synchronism or asynchronously by controlling the operation of their associated alternating valves in a timely manner as may be desired.

It is to be appreciated that each pair of guide wires G is normally maintained in taut condition. However, the solenoids on the rod R1 may suddenly be deenergized thereby releasing the guide wires from their taut condition and causing the nozzle bases or floats to leap upwards out of the water. The energization and deenergization of the solenoids may be controlled manually or by a TIMER mechanism (not shown) to control the dynamic fountain display.

It is also contemplated that adjacent ends of the pairs of rods R1, R2 may be fixed to a pair of coiled springs C, one for each rod, and each coil anchored in coaxial alignment with its associated rod. At their other ends the rods R1, R2 are each attached, as by a cable, to a winch W controlled by a motor M through a gear connection G2. When the motor M is in operation, the winch will draw the rods R1, R2 lengthwise towards it thereby providing an additional motion component for each of the float bases 20. The motor M may be a reversible motor or it may be periodically de-energized by timer means to allow the rods to be retracted by the coiled springs C thereby augmenting the motions of the base floats 20 of the display.

Figure 7:
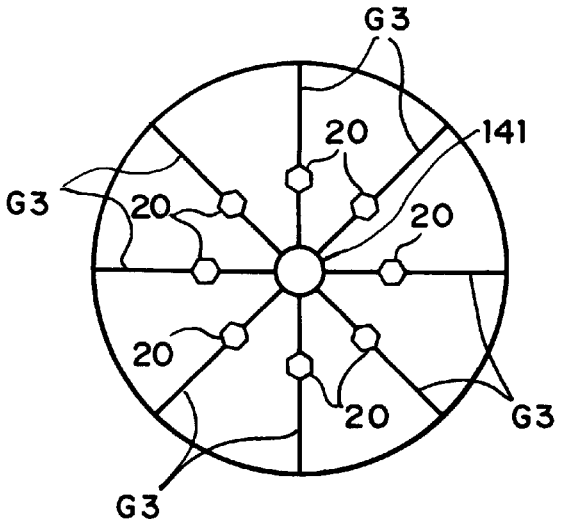
FIG. 7 is a plan view of an array of moveable floats of the type shown in FIG. 1 and wherein the floats are mounted on guides for radial movement with respect to the center of a rigid circular hoop.

FIG. 7 shows another form of fountain display in which a plurality of the base floats 20 are mounted in a circular shaped pool in which a pair of rigid circular hoops 141, 142 are mounted in concentric relation substantially coplanar with the surface of the pool or just below the surface. Each float 20 is mounted on an associated pair of guide wires G3 as shown in FIG. 1 and the ends of each guide wire pair are attached at one end to the inner rigid circular hoop 141 and at their other ends to the outer rigid hoop 142 to extend in a radial direction from the common center of the hoops. Each float 20 is adapted to be connected by hoses to a pump through an alternating valve in an apparatus as shown in FIG. 1. The floats 20 may thus be hydraulically controlled by their nozzles to move in reciprocating radial movement to alternately diverge and converge by a synchronized operation of their associate alternating valves.

A similar fountain display is shown in FIG. 8 where the base floats 20 are mounted on radially extending guides G4 fastened at their ends between a pair of concentric semicircular rigid members comprising an inner member 151 and an outer member 152. As in FIG. 7, the float bases 20 may be moved in radial fashion by their underwater nozzles in controlled synchronism or asynchronously as desired when their nozzles are in operation.

FIG. 9 shows in a top plan view, a plurality of float bases 20 arranged in a pair of circular arrays and mounted on a pair of rigid concentric circular guides 71, 72, in lieu of guide wires. Each float is thus adapted to move on its circular guide in back-and-forth arcuate movement when their nozzles are in operation. The movements may be in unison in synchronism or asynchronically as desired by appropriately controlling the operation of their associated alternating valves.

FIG. 10 is the top plan view of another form of fountain display in which three groups of float bases 20 are mounted in a rectangular pool 75 having arcuate ends of semi-circle shape. The first group of float bases 20 are mounted for sliding movement on a rigid semicircular guide rod 76, in lieu of guide wires. The center of the semi-circle guide 76 is coincident with the center of the semi-circle which defines the end of the pool which is adjacent thereto. A second group of bases 20 is mounted on a second semi-circle guide 77 which is coincident with the center of the other semi-circular end of the pool. Between these two groups of float bases, a third group is mounted on a straight guide 78, either a straight rod or parallel wires which extend between the centers of the guides 76, 77. Members of the third group are adapted to move in reciprocating fashion along the linear guide 78. Base members 20 of the other groups move in arcuate fashion, back and forth, along their semi-circle guides when the nozzles are in operation.

Another type of dynamic display is shown in FIG. 12 wherein there is shown in top plan view, a pair of nozzle bases 20C and 20D which are mounted on respective pairs of guide wires 30C, 30D. The guide wires 30C, 30D are mounted in parallel relation to one another in spaced relation so that the nozzle bases do not collide or interfere with one another as they are controlled to move in reciprocating linear movement along their respective guides. One of the float bases 20C is equipped with nozzles of the type shown in FIGS. 3 and 4 which provides an oscillating fan-type dispersal when the pump and alternating valve are in operation. The other float base 20D is equipped with nozzles which provide a "stick" dispersal, also oscillating when energized. The two bases 20C and 20D may be moved in unison, back and forth, by underwater nozzles as desired to simulate a boy and girl dancing, the girl being represented by float base 20C and the boy being represented by float base 20D.

FIGS. 13A and 13B show another type of display wherein a flexible plastic sheet or the like is mounted on a nozzle base, such as base 20E, along an edge of the sheet. In FIG. 13A, the nozzle base 20E is provided with a pair of nozzles 50A, 50B which produce fan-like dispersals. A flexible plastic sheet 80A, having the silhouette shape of the human body, is mounted along its bottom edge to the deck of the base 20E at a location between the nozzles 50. The base 20E is also equipped with lights L for providing red and yellow light beams, the different colored lights being mounted on opposite sides of the plastic sheet in collinear array with the nozzles. As the fan dispersals are moved in unison in oscillating fan-like motion, the plastic sheet 80A is also moved in swaying pivotal fashion.

In FIG. 13B, the float base 20F is equipped with a similar plastic sheet 80B and lights L for providing different colored light beams. The base 20B, however, is provided with two pairs of nozzles 51A, 51B so as to provide a "stick" dispersal and "fan" dispersal on the other side of the sheet. Preferably, one "stick" nozzle is mounted on the starboard side of the float base and the other "stick" nozzle on the port side. Although the bases 20A, 20B are designed to accommodate guide wires, they can also be made of floatable material and each provided with an under "stick" dispersal nozzle which is pointed downwardly whereby its reaction with the pool water will cause the base to move back and forth in the water. It is to be appreciated that the flexible plastic sheet in FIGS. 13A, 13B might be of a variety of shapes such as to simulate ghosts, animals and the like, or various human forms. The float 20B may also be provided with different colored lights L.

FIG. 14 is a top plan view of another fountain display which has for its intended purpose to simulate kids "fighting". The display comprises a pair of nozzle bases 20G, 20H, each of which is mounted on an associated pair 81, 82 of guide wires. Each of the bases 20G, 20H is equipped with four nozzles arranged in a symmetrical rectangular array and of the type which provides a "stick" dispersal. A fifth underwater nozzle is directed downwardly to move the base along its guide wire. The underwater nozzles of the two bases may be controlled so that the bases pass each other in repetition with all of their dispersals moving in unison and synchronism without interference. The underwater nozzles may then be controlled to stop alongside one another so that their dispersals interact to simulate a "fighting" engagement where eventually one float limps away in defeat an the other struts in victory.

FIG. 15 is a display for simulating an animal 100 walking or swimming in water. The animal is preferably an inflated balloon simulation which is inflatable through an air hose 101 threaded through a flexible conduit 101A and connected to an appropriate source of air pressure (not shown). The "animal" has four legs 102, each provided with a nozzle for producing a "stick" dispersal. The nozzle for each leg is mounted to the interior of the animal at the location of the juncture of the leg with the animal's body. The nozzle is pointed downwardly so that its dispersal stream flows through the leg which is open at its lower end, the "foot" end. It is thus to be appreciated that the oscillating of the nozzle dispersal will cause the leg to pivot at the hip and when done in concert, can be controlled to simulate walking. All of the hoses to the nozzles are fed through the conduit 71 together with the air hose. The nozzles are controlled by an alternating valve and pump as shown in FIG. 1. The inflation of the animal can also be controlled and varied as desired such that the animal can be made to swell and change expression as if "getting mad". The animal is shown to be a bear in FIG. 15 but it could also be in the form of a dog, a cat, a swan or ugly duckling, or even a whale. If the animal is of sufficient size, children could "ride" the animal.

Figure 16:
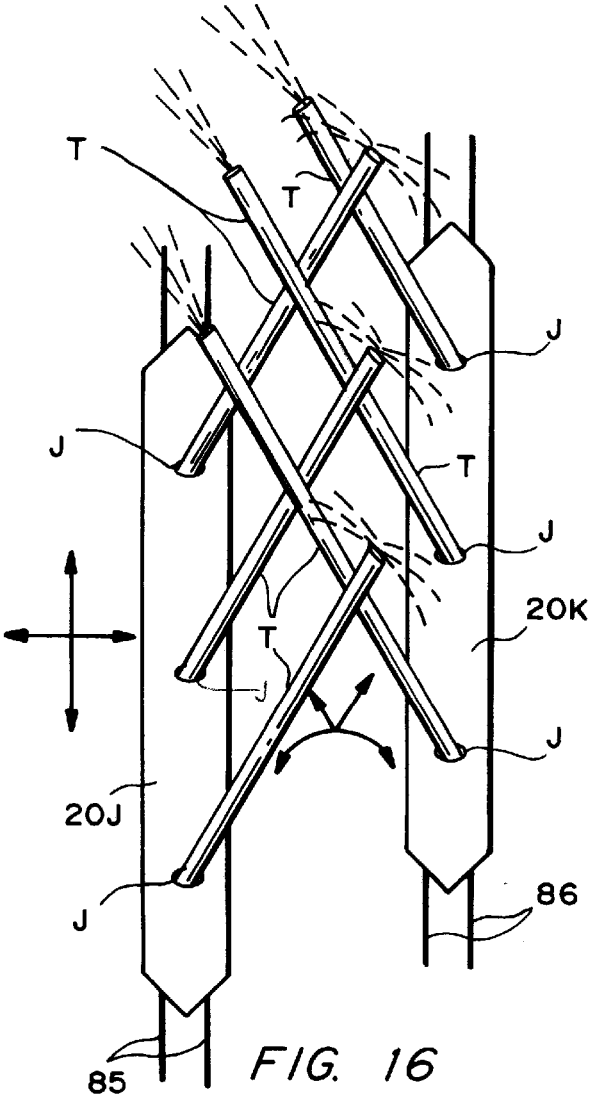
FIG. 16 discloses a pair of nozzle equipped floats, mounted on guide means in proximity to one another and in parallel relation wherein each float is equipped with a plurality of nozzles arranged in linear relation and of the type suitable for producing an oscillating "stick-like" dispersal stream and wherein a plurality of flexible tubings are provided, each fitted about the exit aperture of a different nozzle in a fashion to receive the nozzle dispersal stream therethrough.

FIG. 16 discloses a pair of nozzle bases 20J, 20K which are considerably longer than the bases shown in FIG. 1. The bases 20J, 20K are both slidably mounted on guide means, parallel guide wires, as is the base 20 of FIG. 1, and both sets of guide means are disposed in proximity to one another in parallel relation. Each base 20J, 20K is provided with a plurality of dual entry nozzles of the "stick" dispersal type which are arranged thereon in linear relation. An underwater nozzle is fitted to the underside of each base 20J, 20K. However, fitted to the exit aperture of each nozzle is an open-ended flexible tubing T of thin plastic or the like, such that all of the nozzle dispersal stream is dispensed through the tubing. As the "stick" dispersal is caused to oscillate by operation of an alternating valve and pump as in FIG. 1, the tubing T also oscillates or "waves". The tubings T on the bases 20E can be oscillated in unison and controlled to intermingle with the tubings fitted to the companion base as shown in FIG. 16 when the two bases are moved in reciprocal fashion by their underwater nozzles.

It is also to be seen in FIG. 16 that some of the dispersals from the tubings are "sticklike" and others are of an "umbrella-like" configuration. The "stick" dispersals are provided by an open unrestricted end of the tubing. An "umbrella" dispersal is obtained by providing an end cap for the tubing and a plurality of holes in circular array about the tubing as viewed in a radial cross section. It is also to be appreciated, that in order to keep the tubings stiff, the area of the inlet to the tubing should be larger than the total area of the tubing dispersal outlet or outlets.

Figure 17:
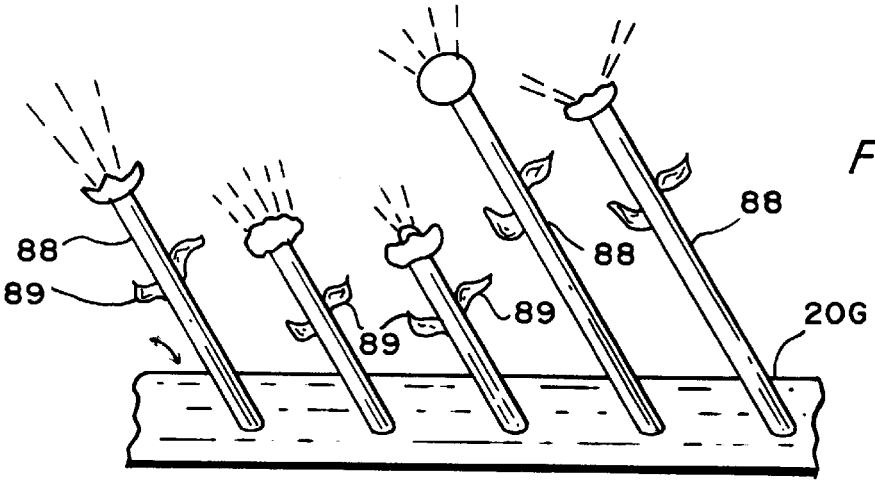
FIG. 17 is a display wherein a float is equipped with a plurality of nozzles of the type for producing a "stick-like" dispersal and each nozzle dispersal stream is directed through a flexible tubing designed to simulate a waving flower.

FIG. 17 is a fragmentary view for illustrating a similar display which includes an elongate nozzle base 20G to which a plurality of open-ended flexible tubular sleeves 88 are fitted to the exit apertures of dual entry nozzles (not shown) mounted on the base 20G. The dispersal stream of each nozzle is dispersed through its associated tubing 88 which may be colored green to simulate the stem of a flower and also provided with appendages 89 which simulate the leaves of the flower. As shown in FIG. 17, the "flowers" may be of various shapes and colors and the "flowers" caused to sway in unison in the breeze when their nozzle streams are oscillated by the apparatus of hoses, alternating valves and pump as shown in FIG. 1.

Figure 18:
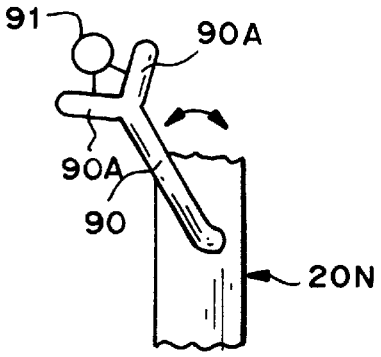
FIG. 18 is a fragmentary view of a float similar to the float in FIG. 17 but wherein the flexible tubing which receives the oscillating nozzle dispersal stream is shaped with "arms" and a "head"

FIG. 18 is a fragmentary view which shows another version 90 of an open-ended flexible tubing which is fitted about the exit aperture of a dual entry nozzle (not shown) mounted on a nozzle base 20H. The upper free end of the tubing 90 is provided with a bulbous head 91 and also with open-ended branches 90A which simulate the arms of a person. When the nozzle stream is oscillated, its dispersal through the tubing 90 and "arms" 90A cause the arms to "wave" such that the display simulates a person in the act of warning or clapping. Changing the volume of water passing through also moves the arms.

Figure 19:
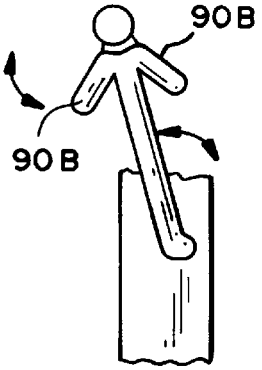
FIG. 19 discloses a display with apparatus substantially identical to the apparatus of FIG. 18 but showing the "arms" in a downwardly directed position.

FIG. 19 discloses apparatus substantially identical to FIG. 18 but showing the "arms" 90B in a downwardly directed position. If the two displays of FIG. 18 and FIG. 19 are placed side by side, the two figures appear to be "fighting", particularly when their bases 20H are moved by their underwater dual entry nozzle (not shown) to a confrontational position.

Figure 20:
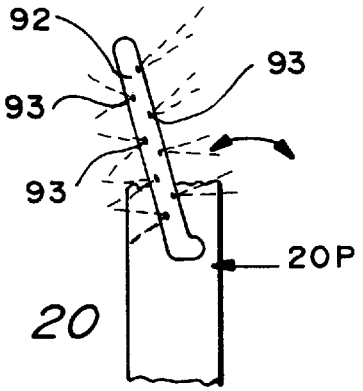
FIG. 20 is a display with apparatus similar to that shown in FIGS. 18 and 19, but wherein the flexible tubing is closed at is upper end and provided along its length with numerous small holes for producing a plurality of dispersal streams.

FIG. 20 is the fragmentary view of still another "stem" or the like wherein the flexible tubing 92 is closed at its upper end but provided with numerous small holes 93 along its length. When one end of the tubing 92 is fitted about the exit aperture of a nozzle on a float base 20P, activation of the system produces a plurality of dispersals through the holes 93.

For the display apparatuses shown in FIGS. 18, 19 and 20, it is to be understood that the float bases are substantially identical to the base 20 shown in FIG. 1 and the various multi-entry nozzles are similarly provided with flexible hoses for connecting their inlets to a pump through an alternating valve.

Figure 21:
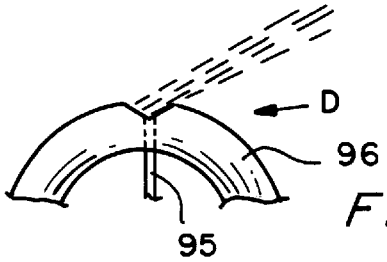
FIG. 21 shows another form of dual entry nozzle similar to the nozzle of FIG. 3 but which is adopted to be connected to a source of air pressure and associated means for intermittently injecting a "shot" of pressurized air into the nozzle dispersal stream.

FIG. 21 shows another form of dual entry nozzle, similar to the nozzle 50 of FIG. 3 but wherein a tube 95 is inserted through the inverted V-shaped tubing 96 substantially at the apex thereof and is adapted to be connected to a source of air pressure and associated means for intermittently injecting a "shot" of air into the nozzle dispersal stream. This type of nozzle can be used in any of the fountain displays described herein for changing the appearance of the display.

Figure 22:
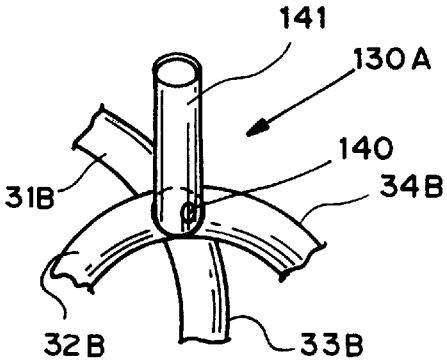
FIG. 22 is a top plan view of still another form of multi-entry nozzle.

FIG. 22 is a top plan view of still another form 130A of multi-entry nozzle which is provided with four entry pipes. The pipes 31B–34B are each adapted to be connected at one end to larger diameter supply conduits (not shown), and arranged in a pyramidal relationship with their outlet ends jointed at the apex of their pyramidal orientation so as to provide an exit aperture 140 such that the dispersal streams emitting from their outlet ends will merge at a location adjacent to the outlets to produce a single dispersal stream. By selectively varying the liquid flow in each of the conduits 31A–34A with respect to each other, the merged dispersal stream may be made to move in a complex manner such as, for example, to describe a cone or similar geometric form by its movement. When an open-ended flexible tubing 141 is fitted about the exit to receive the entire nozzle dispersal stream, the tubing 141 can be made to move in a complex manner as desired.

Figure 23:
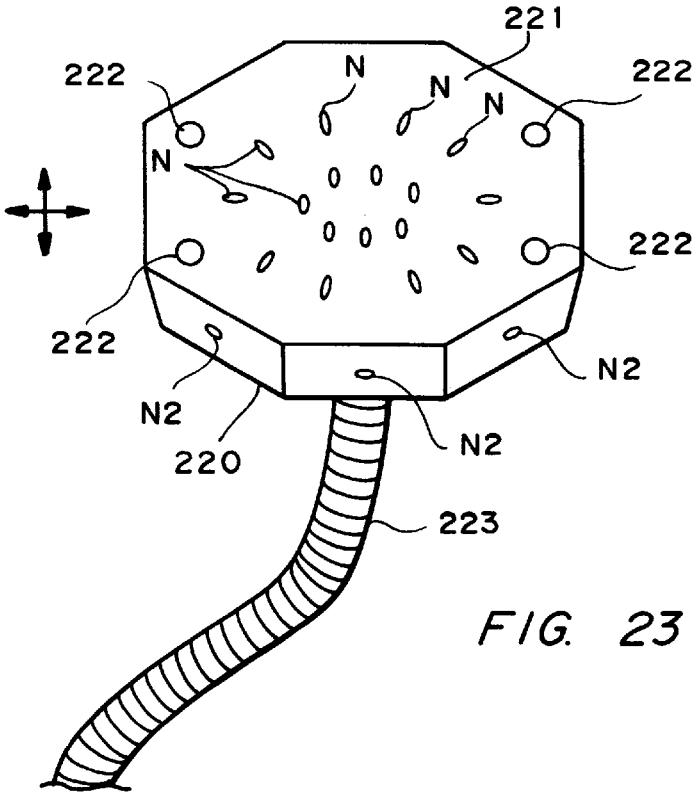
FIG. 23 is another form of fountain display which comprises a base float of light weight floatable material provided with concentric circular arrays of multi-entry nozzles for providing oscillating dispersal streams for display and additional dual entry maneuvering nozzles mounted below the waterline.

FIG. 23 is another form of fountain display which comprises a nozzle base 220, much larger than the base 220 of FIG. 1. The base 220 is of lightweight floatable material and does not require the use of guide wires. Its general form is octagonal in plan view. The float base 220 is provided with concentric circular arrays of multi-entry nozzles N which are mounted therein with their exit apertures opening at the top deck 221 of the float. The float is also provided with dual-entry nozzles N2 which open at the sides of the float below the waterline. The nozzles N2 are mounted such that their dispersal streams oscillate in planes which are approximately horizontal but could be vertical as well. The nozzles N2 serve as maneuvering jets which, when in operation, can be used to steer the float in a desired direction or in desired motions. Lights 222 are also provided on the float for directing different colored beams in the sky-ward direction. A large flexible vacuum-type hose 223 is fitted to the bottom of the float and serves as a conduit for all the hoses connecting to the nozzle inlets and the alternating diverter valves. Electric wiring for the lights may also be directed through the conduit 223.

Figure 24:
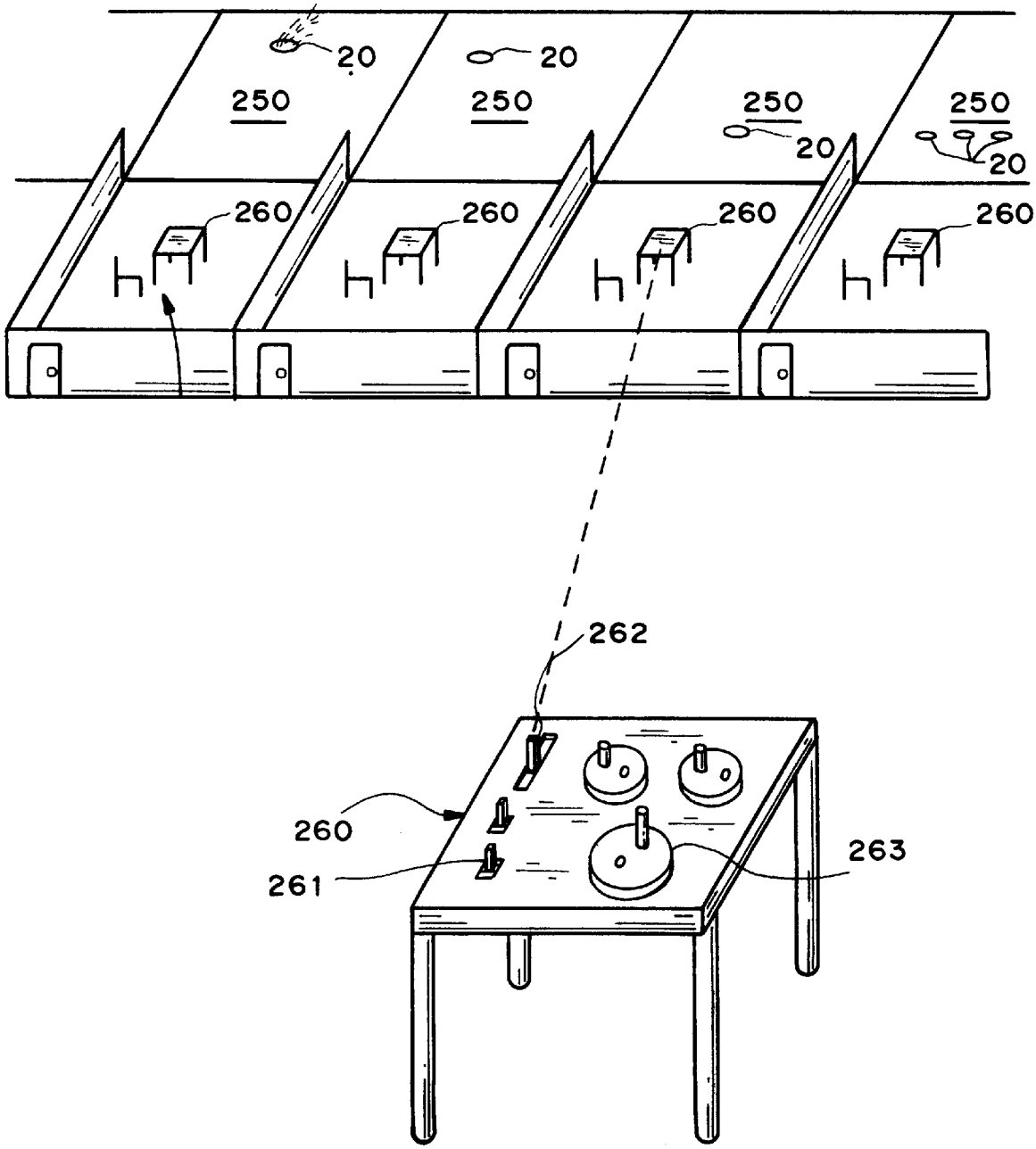
FIG. 24 is a perspective plan view of an array of pools, each of which is provided with one or more of the several fountain displays disclosed herein, and controlled by manual controls provided at a controls table located adjacent the pools.

FIG. 24 is a perspective plan view of a range of pools 250, each of which may be provided with one or more of the several fountain displays which have been described herein. For each pool, at poolside, there is provided a controls table 260 at which an operator may be seated for operating various controls, such as light switches 261, and switches 262, 263 for controlling water pressure and for switching water volume from one group of nozzles in a display to another. For the privilege of operating the controls for the various fountain displays, a financial charge could be imposed.

It is also to be appreciated that a valve with a tubular valve element such as shown and described in U.S. Pat. No. 5,524,822 and incorporated herein by reference, might also be used for controlling the nozzle dispersal streams of the various fountain displays of the invention. Furthermore, while most of the nozzles shown in the display apparatus heretofore have been described as dual entry nozzles, other multi-entry nozzles could be employed as well. Also, in some of the displays single entry nozzles could be used particularly in the displays with flexible stem-like tubings with "stick" dispersals. Single entry nozzles might also be used in the nozzle bases (or float bases) in addition to the multi-entry nozzles.

Figure 27:
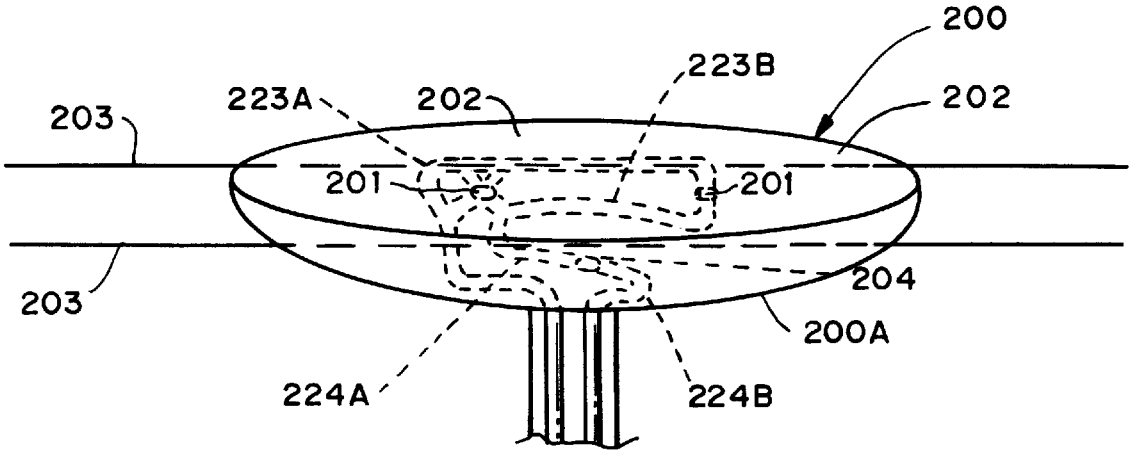
FIG. 27 is another form of nozzle float boat provided with two dual-entry nozzles mounted to open in its upper deck and which may be used to provide a fountain display in accordance with the invention.

FIG. 25 depicts still another fountain display wherein a plurality of float boats 200 equipped with nozzles for providing oscillating nozzle dispersal streams are arrayed and operated to produce an aesthetically pleasing display. The boats 200 are arrayed in a particular spatial relationship to one another such that their pluralilty of nozzle dispersal streams are adapted to move in concert or to interact with another to produce a particular display. A representative nozzle float boat 200 with two dual-entry nozzles 201 mounted to opening the boat's upper deck 202 is shown in FIG. 27. Each boat 200, similar to the float 20 in FIG. 1 but with a more arcuate shaped hull 200A, is adapted to move in a reciprocatory sliding manner along parallel wire guides 203 by provision of a dual entry nozzle 204 mounted on the boat with its aperture below the water line whereby oscillatory motion of its dispersal stream drives the float base 200 back and forth along the guide wires. The nozzle 204 is arranged and mounted such that its dispersal stream will oscillate and pivot in a fore and aft vertical plane through the keel of the float base 200A and in an arc of movement which is approximately 180 degrees. Each of the nozzles 201 and underwater nozzle 204 has a pair of entry ports which are connected by flexible conduits, such as hoses 223A, 223B and 224A, 224B respectively, which extend from the float boat to the dual outlets of an alternating valve provided in the several valve clusters located in the manifold and valving arrangement shown in FIG. 26.

The deck-mounted nozzles on the vertically striped floats in FIG. 25 are dual entry nozzles of the type which provides an oscillating flip-flop "fan-like" dispersal stream as described in U.S. Pat. No. 4,177,925 whereas the unmarked floats 200 are provided with a type of nozzle which provides a "stick-like" dispersal stream as described in U.S. Pat No. 5,524,822. For purposes of clarity only one dispersal stream, instead of two or more, is shown emanating from the decks of the float 200. As previously stated, the dual-entry nozzle is particularly suited for use where a back-and-forth motion of the dispersal stream is desired, which can be accomplished by selectively increasing the flow to one inlet conduit as compared with the flow in the other, or to re-position the nozzle dispersal stream in an instantaneous manner by abruptly transferring a full pressure flow from one input port to the other.

A control apparatus and valving arrangement which may be used to deliver water the nozzles mounted on the float boat 200 is shown in FIG. 26. The apparatus includes a pump 205 which is adapted to pump water from a source of water to a manifold 206 with branches 206A, 206B. Each branch of the manifold 206 connects to a cluster valve 207 which includes an alternating diverter valve 208, similar to the valve 100 in FIG. 5, and the inlet of which communicates with the manifold 206 through a conventional ON-OFF valve 209 in a connecting control 210. The two outlets of the valve 208 are connected through feed conduits 211A, 211B to the dual entry ports of the dual entry nozzle 201 in one of the float boats 200. It is to be understood that each nozzle in a float boat 200 is connected to a valve cluster 207 and is controlled thereby. It is also to be seen that an ON-OFF stop valve 201 is connected between the two valve outlet conduits 211A, 211B.

As shown in FIG. 25, three unmarked and two vertically striped float boats are shown in six stages (still-shots) as they move across a tank or pool of water. Between each pair, a float boat marked with dashed lines is located. This method of presentation is chosen to show the versatility of the valving manifolds 206A, 206B such that the three unmarked boats move to the right across the tank as their travel is being manipulated by the top cluster 207B of valves on the right of FIG. 26. The fountain dispersal atop the unmarked boats is being manipulated by the cluster 207 of valves on the left. During the entire crossing the diverter valve in each cluster can be timed to only move the dispersal across its arc only once, from one side of the dual-entry nozzle to the other.

In FIG. 25 there are shown two striped boats moving to the left, their movement being manipulated by the third down cluster 207G of valves on the right side of FIG. 26. The striped boats might be traveling at a different rate of speed from the unmarked boats according to the setting of the ON-OFF valve 209. The third-down cluster 207C of valves on the left side of FIG. 26 controls the fountain arc dispersal stop the striped boats. The diverter valve in this valve cluster can be set to rotate rather rapidly if desired so that the dispersal streams on the striped boats oscillate rapidly in contract to the slow moving oscillating fountain streams on the unmarked boats. The five dashed-striped boats are dead in the water in the sketch of FIG. 5 because their associated ON-OFF valves 209 are completely closed. If so desired, a fountain designer could leave the valves 209 open and the fountains dispersals would continue to perform even through their vehicle is dead in the water.

Figure 28:
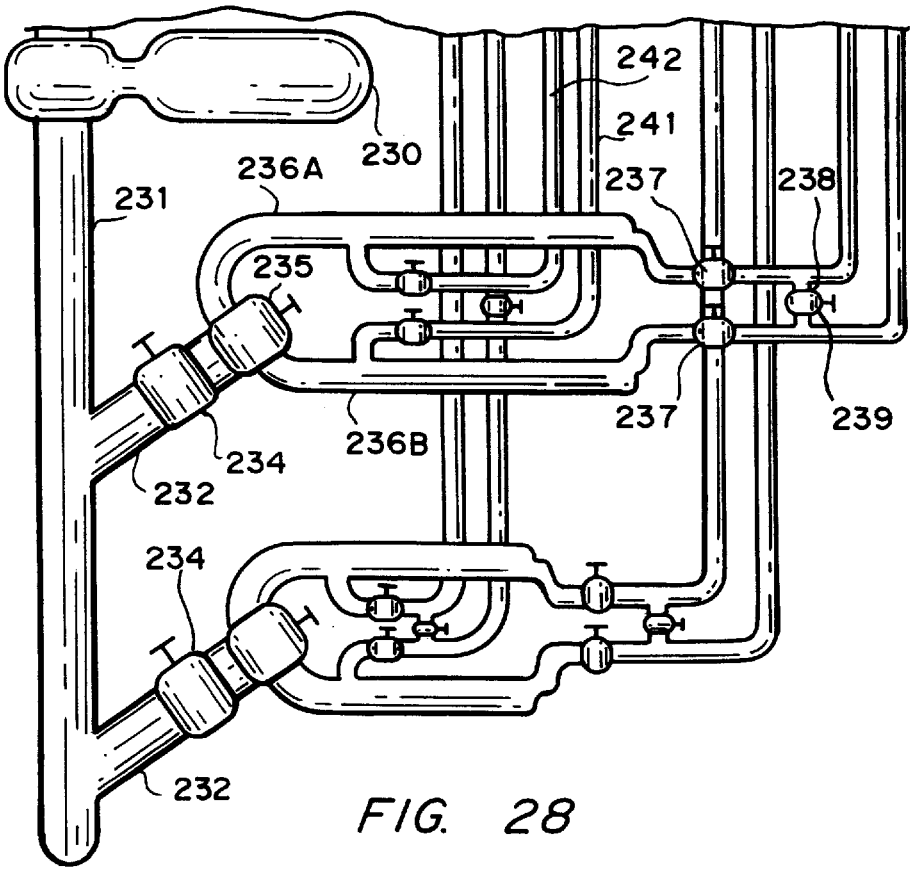
FIG. 28 is a schematic illustration of an alternative form of controls apparatus and valving arrangement which can be used to control the movements to nozzle dispersal streams for an array of nozzles used in forming a fountain display in accordance with the invention.

Another versatile valving manifold system for manipulating fountains is shown in FIG. 28.

The system includes a pump 230 to suction water from an appropriate water supply and deliver the water to a manifold 231 with outlet branches 232. Each of the manifold branches 232 is connected to a valve cluster through an ON-OFF valve 234 installed therein. The outlet of the valve 234 is connected to the inlet of a diverter valve 235 having its two outlets connected to a pair of conduits 236A, 236B in each of which is installed an ON-OFF valve 237. The conduits 236A, 236B each connect to a different inlet of a dual entry nozzle which may be employed in any of the fountain displays disclosed herein. It is also to be noted that a conduit 238 connects across the conduits 236A, 236B at a location on the downstream side of the valve 237 and includes another ON-OFF valve 239. Preferably, the several ON-OFF valves in the valve cluster including the valves 234 are electrically controlled solenoid valves so as to provide for a fast ON and OFF. However, they might be any valve which is controllable to vary the outlet flow so that a fountain designer can change the height of a dispersal stream at will. The diverter valve 235 is the principal manipulator for constantly moving a nozzle dispersal stream back and forth throughout its arc of movement and if connected to a single sentry nozzle, can control the height of its dispersal stream. The ON-OFF valves 239 connecting across the conduits 236A, 236B serve as "fast-trick" valves because when placed open in "ON" condition, they equalize the liquid flows in the conduits 236A and 236B and accordingly, the flows of liquid to the two entry ports of the dual entry nozzle with which they connect, thereby bringing the nozzle dispersal stream to a halt in the center of its arc of movement and holding it in such condition while the diverter valve 235 continues switching the dispersal streams of other dual entry nozzles to which its valve outlets may be connected. To provide for such capability, a second pair of tributary conduits 241, 242, each connecting with a different one of the conduits 236A, 236B, are connectable to the dual entry ports of another dual entry nozzle in a display. The diverter valve 235 thereby is operable to oscillate a nozzle dispersal stream by alternating the liquid flows through the conduits 241, 242 while holding steady the dispersal stream from the nozzle connecting to the outlets of the ON-OFF valves 237. Preferably, the conduits 241, 242 are also provided with a cross conduit 243 and an ON-OFF valve 244 for equalizing the flows to the inlets of a dual entry valve connecting with the conduits 241, 242.

It is to be appreciated that the two pairs of conduits 241, 242 and conduits 236A, 236B and corresponding pairs in the second cluster of valves in FIG. 28 are directly connectable to the dual entry nozzles on the float boats shown in FIG. 25. It is also to be understood that the valving manifold system in FIG. 28 can be modified to provide the necessary number of manifolds with associated valves and conduits to accommodate a specific number of arrays and display nozzles.

Figure 29:
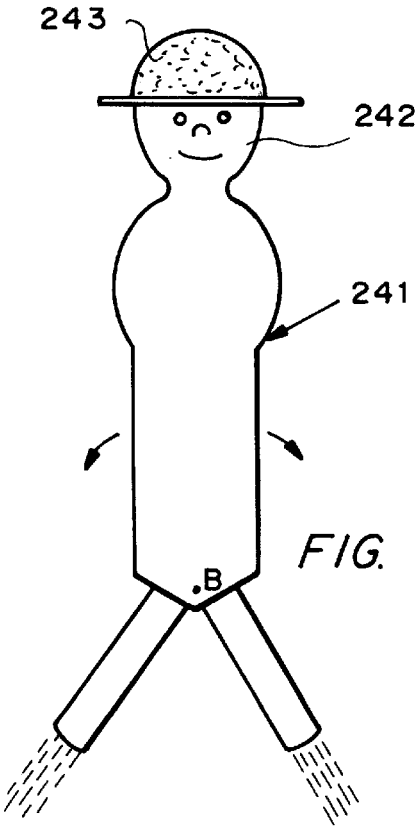
FIG. 29 is a front view of a flexible tubing adapted to be attached to a dual entry nozzle to simulate a person and which may be used in a fountain display in accordance with the invention.

In FIG. 29 there is shown a "clothed" nozzle which ceases to be a fountain and becomes an actor or puppet when activated and propelled by a fountain nozzle dispersal which passes through a flexible tubing 241. The tubing 241 may be shaped as a human figure with a head 242, a hat 243 and arms if so desired, and provided with a bottom opening fixed in surrounding relation to the outlet of a dual entry nozzle to receive its dispersal stream. The fountain dispersal with its strong velocity hits the hard top inside the flexible tube and stretches it out with all the water falling down the tubing wall inside the tubing. A pin shown at B in FIG. 29 is provided to hold the body (tubing) to the dual-entry nozzle although other fastening means might be used.

Figure 30:
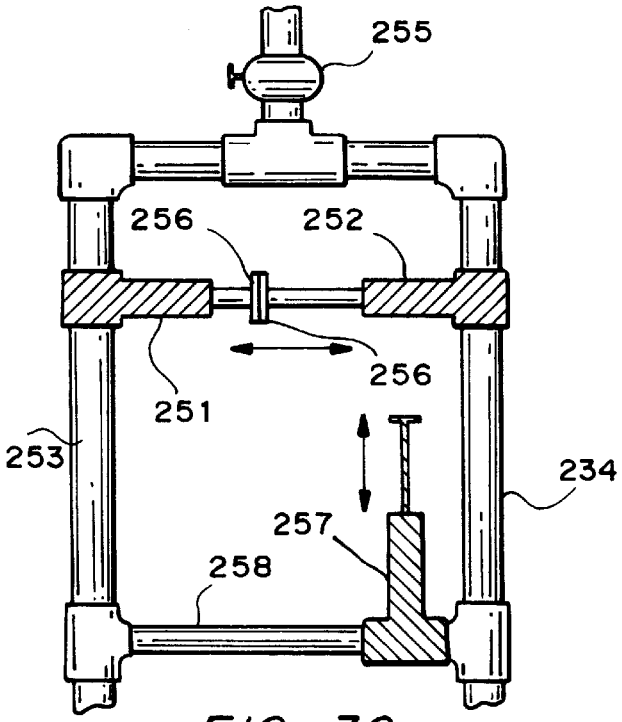
FIG. 30 is an illustration of an alternative manifold and valving arrangement incorporating sliding gate valves which can also be used for controlling the operating of the nozzle dispersal streams in the various displays shown herein.

FIG. 30 shows how sliding-handle gate valves might also be used as an alternating valve in the invention. The two sliding valve elements in the gate valves 251, 252 are provided with handles 251A, 252A at their external ends and which are joined together at their handles so as to be in coaxial relationship. Each gate element is a rectangle in cross section and controls flow through a conduit with valve 252 controlling conduit 254 and valve 251 controlling conduit 253. The conduits 253, 254 both receive liquid from a supply manifold (not shown) through a common ON-OFF valve 255. Joining the two handles at their ends 256 permits a rack and pinion operation for producing linear motion which might be easily motorized and programmed. Another gate valve 257 is also provided in a cross conduit 258 which connects conduits 253 and 254 and is operable to equalize the flows therethrough and thereby bring an oscillating dispersal stream to a stationary position.

Figure 31:
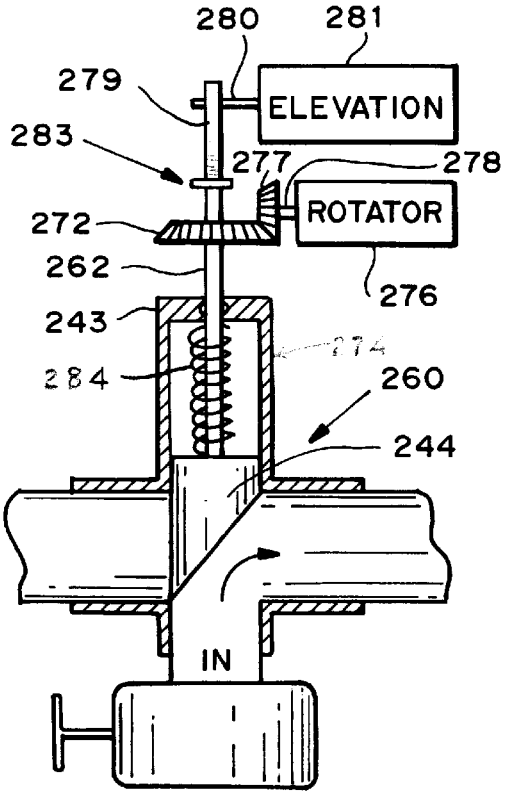
FIG. 31 is a view in cross section of a plug valve (diverter valve) similar to that shown in FIG. 6 but which is shown operatively connected to a drive mechanism for controlling valve operations.

FIG. 31 shows a fast-rotating tapered plug valve 260 which could also be used to control the alternating supply of liquid to the dual inlets of a dual entry nozzle. It satisfies the requirements of equal-increment switching for a diverter valve and its rotary motion could be easily motorized and programmed. In a very unique fashion this one rapid moving valve can replace the two diverter valves 234 and the ON-OFF valves 238 in FIG. 28, and it could just as easily be motorized and programmed. The rising plug and stem just as easily negates the volume differential to the dual entry nozzles as does the valve 239 in FIG. 28.

In FIG. 31 the valve 260 is provided with a valve stem 262 which is connected to the valve plug element 244 in coaxial alignment therewith. The stem 262 extends through the transverse member 243 at the end of the valve body 244 in sealing relationship therewith.

To permit selective axial rotation of the stem 262, the stem is fitted with an annular bevel gear 272 in drive connection with a reversible motor 276 by means of a gear 277 on a motor drive shaft 278. To permit linear movement of the stem, a cam wheel 279 is fitted to the drive shaft 280, of an elevative drive motor 281 and as the shaft 280 rotates, the cam wheel in abutting engagement with the top of a ball bearing housing 283 on the end of the stem drives the stem downwardly. A coiled spring 284, attached to the inside surface of the transverse valve housing member 243 and the top of the valve plug 244 and sleeved about the stem 262 serves to retract the plug 244 to its uppermost position as the cam continues its rotation. By either manual or electronic means, the speed and direction of rotation of the motor 276 and rotation of motor 281 may be programmed to control the speed of rotation and speed of axial movement of the valve plug element 244 and thereby control the timing and the fluid communication of the yalve inlet and outlets and thereby the timing and delivery of water to the various dual entry nozzles in a particular nozzle array.

Figure 32:
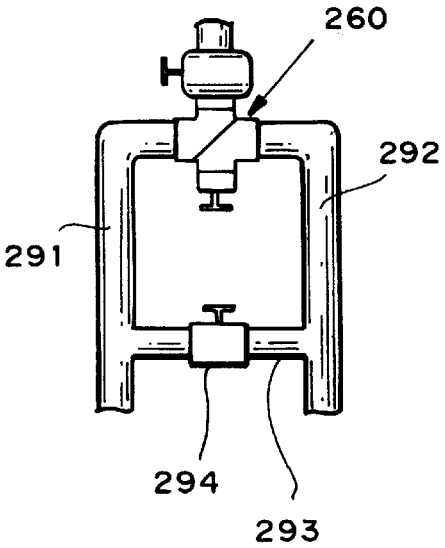
FIG. 32 shows a tapered plug valve used as a diverter valve in an arrangement with a conventional ball valve, or the like, which can also be used in a dual-entry manifold for controlling nozzle dispersal stream operations.

FIG. 32 shows how the easily-rotated tapered plug valve 260 could efficiently be used in a dual manifold 291A, 291B. The conduits 291, 292 may also be connected by a cross conduit 293 with an ON-OFF valve 294 therein for equalizing flows in the conduit pair and to the dual inlets of a dual entry nozzle connecting therewith.

It is to be noted therefore that the apparatus for a fountain display disclosed herein makes it possible to import complex movements to a fountain dispersal stream or an array of such streams by hydraulic means alone while the fountain source of the stream is maintained stationary or is itself moved by hydraulic forces provided by such streams.

The fountain system disclosed herein is unique in that it used hydraulics to emulate very too complicated mechanical movements easily and inexpensively. Innumerable animated water effects can be installed by merely connecting special valves to ganged nozzle arrays. This simple construction allows the water effects designer to create a beautiful display that would otherwise require complicated and expensive mechanisms to implement.

The fountain system of the invention also uses variation of a dual-entry nozzle and diverter valve combination. The dual-entry nozzle has one exit but two inlets set at a selected angle from the exit, the particular angle selected thereby controlling the oscillating arc of movement of the nozzle dispersal stream, which angle corresponds thereto. This allows the dispersal to travel in various patterns as water volume is modulated from one inlet to the other. The modulation of water volume between the inlets is easily accomplished by the diverter valve which can modulate a water supply to two or more outlets with great efficiency and agility. It is therefore possible to develop a great many variations of this diverter valve in single and ganged arrangements to produce a great number of effects in combination with the aforementioned nozzles.

It is also to be appreciated that the inherent capability of the system can be extraordinarily enhanced by the addition of computer control technology for operation of the mechanical valves so as to enable the water effects designer to orchestrate elaborate and dramatic production of water, light and music at extremely low cost.

The invention also uses the aforesaid components of the system to move a boat equipped with one or more dual-entry nozzles. The nozzle boat motivate by nozzles under the water line carries display nozzles on the top, with all nozzles fed from a remotely mounted valve via flexible hoses. The nozzle boat adds yet another dimension to the versatile system which can also be used if desired as an interactive amusement device wherein the viewer can control the water effects. In its simple form this could be implemented without any but manual control of the diverter valve by the viewer. The scale of such a system can be varied to suit locations varying in size from lobbies and malls to outdoor water shows at theme parks.

It is also to be understood that the foregoing description of the invention has been presented for purposes of illustration and explanation and is not intended to limit the invention to the precise forms disclosed. It is to be appreciated therefore that various material and structural changes may be made by those skilled in the art without departing from the spirit of the invention.

I claim:

1. A fountain apparatus for producing fountain streams and sprays adapted to move in complex oscillatory fashion to provide an aesthetically pleasing and entertaining display, said apparatus comprising:

a float provided with a hull adapted for flotation in a body of water;

a first dual entry nozzle having dual entry ports and a single exit port, said first dual entry nozzle being mounted on said float with its exit port providing an opening in the top of said float;

a second dual entry nozzle having dual entry ports and a single exit port, said second dual entry nozzle being mounted on said float with its exit port providing an opening in the hull of the float below the waterline;

liquid supply means for generating and delivering pressured flows of liquid medium from a reservoir of liquid to the dual entry ports of said first and second dual entry nozzles, said liquid supply means including a pump having an outlet port and a conduit system connecting said pump outlet with each of the dual entry ports of said first and second dual entry nozzles; and valve means in said conduit system for communicating the outlet of said pump with the dual entry ports of each of said first and second dual entry nozzle in a fashion to produce a nozzle dispersal stream from the exit port of each of said first and second dual entry nozzle which moves in an oscillatory fan-like motion;

said second dual entry nozzle being mounted in and oriented with respect to said float such that the nozzle dispersal stream from said second dual entry nozzle moves in an oscillatory pivotal motion to thereby produce a thrust force resulting in a reciprocating oscillatory to and fro movement of said float, wherein, the nozzle dispersal stream produced from said first dual entry nozzle ejects upwardly from the hull of said float.

2. A fountain apparatus as set forth in claim 1 further including guide means for controlling the direction of movement of said float.

3. A fountain apparatus as set forth in claim 2 wherein said guide means are located below the surface of water in which said float is located.

4. A fountain apparatus as set forth in claim 1 wherein the float is provided with electric illumination means for directing a beam of light upward from the float.

5. A fountain apparatus as set forth in claim 1 wherein said float is provided with a deck and with additional dual entry nozzles, each having dual entry ports and a single exit port which opens in the deck and said apparatus includes conduits which join each of the entry ports of the additional dual entry nozzles to the outlet port of the pump.

6. A fountain apparatus as set forth in claim 5 wherein at least one of the dual entry nozzles having an exit port opening in the deck of the float is provided with means for producing an oscillating fan-like dispersal when pressured liquid flows are delivered to its entry ports by said pump.

7. A fountain apparatus as set forth in claim 5 wherein a sheet of flexible material of select configuration is fastened along one edge to the deck of the float between the deck openings corresponding to the exit ports of a pair of said dual entry nozzles and is maintained upright and imparted with an oscillatory waving motion by the nozzle dispersal streams from said pair of dual entry nozzles which impact thereon in alternating fashion to thereby simulate the motion of animate or inanimate creatures.

8. A fountain apparatus as set forth in claim 5 wherein at least two of the dual entry nozzles having an exit port which opens in the deck of the float are each provided with means for producing an oscillating dispersal stream from its exit port when pressured liquid flows are delivered to their entry ports by said liquid supply means and said valve means, said apparatus further including a flexible sheet which is fastened to said float along an edge portion of said sheet and can be maintained in an upright position and moved in pivotal fashion about its fastened edge portion by the oscillating dispersal streams from said at least two dual entry nozzles.

9. A fountain apparatus as set forth in claim 8 wherein said sheet is configured in the outline of an animal creature.

10. A fountain apparatus as set forth in claim 1 further including means for manually operating said pump and valve means to control the speed and magnitude of oscillation of the nozzle dispersal streams.

11. A fountain apparatus as set forth in claim 1 further comprising a plurality of said floats arranged in an array whereby the nozzle dispersal streams of the nozzles having exit ports in the top of said float are adapted to be moved in concert as individual ones of said floats are moved in reciprocating back and forth fashion.

12. A fountain apparatus as set forth in claim 1 further comprising a flexible tubular sleeve which at one end is fastened to the float in encompassing relation to the exit port of said first dual entry nozzle which opens in the top of said float whereby said flexible tubular sleeve receives the nozzle dispersal stream of said first dual entry nozzle and moves in concert with the nozzle dispersal stream of said first dual entry nozzle.

13. A fountain apparatus as set forth in claim 1 wherein the float in said fountain apparatus is provided with at least one dual entry nozzle communicating with said valve means and pump mounted on the float with its exit port below the waterline and in an orientation such that the nozzle dispersal stream moves in an oscillatory motion in a plane which is other than vertical.

14. A fountain apparatus for producing fountain streams and sprays adapted to move in complex oscillatory fashion to provide an aesthetically pleasing and entertaining display, said apparatus comprising:

a float provided with a hull adapted for flotation in a body of water, said hull having a centerline keel;

a first dual entry nozzle having dual entry ports and a single exit port, said first dual entry nozzle being mounted on said float with its exit port providing an opening in the top of said float;

a second dual entry nozzle having dual entry ports and a single exit port, said second dual entry nozzle being mounted on said float with its exit port providing an opening in the hull of the float below the waterline and along the centerline thereof;

liquid supply means for generating and delivering pressured flows of liquid medium from a reservoir of liquid to the dual entry ports of said first and second dual entry nozzles, said liquid supply means including a pump having an outlet port and a conduit system connecting said pump outlet with each of the dual entry ports of said first and second dual entry nozzles; and valve means in said conduit system for communicating the outlet of said pump with the dual entry ports of each of said first and second entry nozzle in a fashion to produce a nozzle dispersal stream from the exit port of each of said first and second dual entry nozzle which moves in an oscillatory fan-like motion;

said second dual entry nozzle being mounted in and oriented with respect to said float such that the nozzle dispersal stream from said second dual entry nozzle moves in an oscillatory fan-like motion in a plane coincident with the centerline of the hull.

15. A fountain apparatus as set forth in claim 14 further comprising a plurality of said floats in an array whereby the nozzle dispersal streams are adapted to move in concert to provide an aesthetically pleasing display.

* * * * *